US011499776B2

(12) United States Patent
Kobayashi et al.

(10) Patent No.: US 11,499,776 B2
(45) Date of Patent: Nov. 15, 2022

(54) METHOD FOR CONSTRUCTING NATURAL GAS LIQUEFACTION PLANT

(71) Applicant: Chiyoda Corporation, Yokohama (JP)

(72) Inventors: Kenichi Kobayashi, Yokohama (JP); Takeshi Kaji, Yokohama (JP); Makoto Yamagata, Yokohama (JP)

(73) Assignee: Chiyoda Corporation, Kanagawa (JP)

( * ) Notice: Subject to any disclaimer, the term of this patent is extended or adjusted under 35 U.S.C. 154(b) by 301 days.

(21) Appl. No.: 16/603,773

(22) PCT Filed: Mar. 15, 2018

(86) PCT No.: PCT/JP2018/010266
§ 371 (c)(1),
(2) Date: Oct. 8, 2019

(87) PCT Pub. No.: WO2018/198573
PCT Pub. Date: Nov. 1, 2018

(65) Prior Publication Data

US 2020/0116426 A1 Apr. 16, 2020

(30) Foreign Application Priority Data

Apr. 26, 2017 (JP) ..... JP2017-087195

(51) Int. Cl.
*F25J 1/02* (2006.01)
*F25J 1/00* (2006.01)

(52) U.S. Cl.
CPC ..... *F25J 1/0257* (2013.01); *F25J 1/0022* (2013.01); *F25J 1/0259* (2013.01)

(58) Field of Classification Search
CPC ..... F25J 1/0257; F25J 1/0022; F25J 1/0259; F25J 2290/70; F25J 2290/42; F25J 1/0283; F25J 1/0275; F02C 7/20; F02C 7/32
See application file for complete search history.

(56) References Cited

U.S. PATENT DOCUMENTS 5,327,730 A * 7/1994 Myers ..... F25J 1/0022 62/614
10,920,669 B2 * 2/2021 Giancotti ..... F01D 15/08
(Continued)

FOREIGN PATENT DOCUMENTS

JP 2016514823 A 5/2016
WO 2014028961 A1 2/2014
(Continued)

OTHER PUBLICATIONS

English translation of International Search Report for International Application No. PCT/JP2018/010266, dated May 29, 2018, 1 page.

*Primary Examiner* — Brian M King
(74) *Attorney, Agent, or Firm* — Armstrong Teasdale LLP

(57) ABSTRACT

Provided is a method of constructing a natural gas liquefaction plant, which can shorten a construction time period by minimizing effect of a lead time for the refrigerant compressor thereon, the method including: transporting a refrigerant compression module body 175 to an installation area 85, wherein the refrigerant compression module body is provided with a frame 120 configured to allow refrigerant compressor 150 for compressing a refrigerant for cooling natural gas to be mounted therein; installing the refrigerant compression module body 175 to the installation area 85; and mounting the refrigerant compressor 150 into a mounting space 130 predefined in the frame 120 of the installed refrigerant compression module body.

7 Claims, 10 Drawing Sheets

(56) References Cited

U.S. PATENT DOCUMENTS

| | | | | |
|---|---|---|---|---|
| 2006/0213222 | A1* | 9/2006 | Whitesell | F25J 1/0288<br>62/612 |
| 2006/0213223 | A1* | 9/2006 | Wilding | F25J 1/0247<br>62/613 |
| 2014/0053599 | A1* | 2/2014 | Byfield | F25J 1/0022<br>29/890.035 |
| 2016/0010916 | A1* | 1/2016 | Byfield | B63B 35/44<br>62/611 |
| 2016/0116209 | A1* | 4/2016 | Nagao | F25J 1/023<br>62/53.2 |
| 2017/0160009 | A1* | 6/2017 | Takezawa | F25J 1/0296 |
| 2017/0328631 | A1 | 11/2017 | Kobayashi et al. | |

FOREIGN PATENT DOCUMENTS

| | | | |
|---|---|---|---|
| WO | 2016092593 | A1 | 6/2016 |
| WO | 2017062155 | A1 | 4/2017 |
| WO | 2017140765 | A1 | 8/2017 |

* cited by examiner 1
2
3
4
5A
5B
5C
6
11
12
15
21
31
32
33
34
35
36
37
51
52
53
54
55
56
57
58
59
61
62
63
64
65,66
L1
L2
L3
L4
L5
L6
L7
L8
L9
L10
L11
L15
L16
L21
L22
L24
L25
LNG
raw mtrl gas
(natural gas)
acidic gas
water
steam
heavy
components
prpn
refrgnt 175
69
123a
123
122
120
125
124
121
122
133
126
90
121
145
146

METHOD FOR CONSTRUCTING NATURAL GAS LIQUEFACTION PLANT

CROSS-REFERENCE TO RELATED APPLICATIONS

This application is a U.S. National Phase Application of PCT/JP2018/010266, filed Mar. 15, 2018, which claims the benefit of priority to JP Application No. 2017087195, filed Apr. 26, 2017, the contents of which are hereby expressly incorporated by reference in their entirety.

TECHNICAL FIELD

The present invention relates to a method for constructing a natural gas liquefaction plant including one or more modularized facilities.

BACKGROUND ART

In construction methods of the prior art, one example is a method for constructing a natural gas liquefaction plant (hereafter also referred to as "LNG plant") involves the step of assembling necessary facilities at a construction site, where the necessary facilities include an acidic gas removing facility for removing acidic gases contained in a raw material gas to be subjected to a liquefaction, a moisture removal facility for removing moisture contained in the raw material gas, and compression equipment for compressing a refrigerant (such as mixed refrigerant or propane refrigerant) used for cooling and liquefying the raw material gas.

One of known techniques for promoting efficiency of the above-described construction work performed a construction site is a method including the steps of: assembling functional facilities provided with equipment and apparatuses mounted therein of such an LNG plant as modularized facilities (hereafter also referred to as simply "module(s)") at a place remoted from a construction site; and transporting the assembled modules to the construction site. (See Patent Document 1)

PRIOR ART DOCUMENT(S)

Patent Document(s)

Patent Document 1: JP2016-514823A

SUMMARY OF THE INVENTION

Task to be Accomplished by the Invention

The aforementioned Patent Document 1 teaches that an LNG plant provided with a refrigerant compression module for compressing a refrigerant stream used to cool a natural gas stream, and designed to include equipment and apparatuses necessary for compressing the refrigerant stream within the module. The refrigerant compression module disclosed in the document is designed to be assembled at a place remote from a construction site such that the necessary equipment and apparatuses are mounted in the module before the assembled module is transported to the construction site.

However, as a refrigerant compressor mounted in the refrigerant compression module tends to have a longer lead time compared to the other equipment and apparatuses included therein, the method, in which the refrigerant compressor is mounted in the module at a place remote from a construction site before the assembled module is transported to the construction site, requires a longer time before the refrigerant compression module can be transported to the construction site due to a longer lead time of the refrigerant compressor. As a result, an entire construction period also becomes longer.

The present invention has been made in view of such problems of the prior art, and a primary object of the present invention is to provide a method for constructing a natural gas liquefaction plant to minimize a construction time period by resolving those problems.

Means to Accomplish the Task

A first aspect of the present invention provides a method for constructing a natural gas liquefaction plant including a modularized facility, the method comprising: transporting a refrigerant compression module body to an installation area, wherein the refrigerant compression module body is provided with a frame configured to allow a refrigerant compressor to be mounted therein, the refrigerant compressor compressing a refrigerant used to cool natural gas; installing the refrigerant compression module body in the installation area; and mounting the refrigerant compressor into a mounting space predefined in the frame of the installed refrigerant compression module body.

According to the present invention, in a method of constructing a natural gas liquefaction plant provided with a refrigerant compressor module including a refrigerant compressor for compressing a refrigerant used to cool natural gas, a refrigerant compression module body is installed before the refrigerant compressor in the refrigerant compression module body is mounted, which can thereby minimize adverse effect of a lead time for the refrigerant compressor on a construction period.

According to a second aspect of the present invention, provided is the method according to the first aspect of the present invention, wherein one or more air-cooled heat exchangers are disposed at a top of the frame, and wherein at least a part of the mounting space is located below the one or more air-cooled heat exchangers.

This configuration utilizes a space in the frame where the refrigerant compressor does not occupy as a mounting space for the air-cooled heat exchangers, thereby enabling efficient use of the space in the frame.

According to a third aspect of the present invention, provided is the method according to the first or second aspect of the present invention, wherein the refrigerant compressor is secured on a floor at a lowest part of the frame.

This configuration can make it easy to mount the refrigerant compressor into the refrigerant compression module body.

According to a fourth aspect of the present invention, provided is the method according to any of the first to third aspects of the present invention, wherein the refrigerant compressor comprises a refrigerant inlet pipe and a refrigerant outlet pipe, wherein the refrigerant compression module body comprises two refrigerant pipes which correspond to the refrigerant inlet pipe and the refrigerant outlet pipe, respectively, and wherein, in the step of mounting the refrigerant compressor, the refrigerant inlet pipe and the refrigerant outlet pipe are connected to their corresponding refrigerant pipes via joint pipes.

This configuration can achieve the stable connection of the refrigerant inlet and outlet pipes of the refrigerant compressor to their corresponding refrigerant pipes provided in the refrigerant compression module body regardless of how accurately the refrigerant compressor is mounted.

According to a fifth aspect of the present invention, provided is the method according to the fourth aspect of the present invention, wherein both the refrigerant inlet pipe and the refrigerant outlet pipe are provided so as to protrude upward from a body of the refrigerant compressor.

This configuration makes it easy to connect the refrigerant inlet and outlet pipes to their corresponding refrigerant pipes.

According to a sixth aspect of the present invention, provided is the method according to any of the first to fifth aspects of the present invention, wherein the method further comprises arranging an exhaust gas pipe outside the frame, the exhaust gas pipe allowing exhaust gas to be discharged outside from the gas turbine.

This configuration allows a mounting space for the refrigerant compressor in the frame of the refrigerant compression module body (and thus the size of the refrigerant compression module body) to be compact, while minimizing extension of time period for the refrigerant compressor mounting step, thereby minimizing a construction time period.

According to a seventh aspect of the present invention, provided is the method according to the sixth aspect of the present invention, wherein an intake port of the gas turbine is provided such that, when the refrigerant compressor is mounted in the mounting space, the intake port extends out of the frame.

This configuration enables a stable air intake of the gas turbine for driving the refrigerant compressor with the simple structural feature.

Effect of the Invention

According to the present invention, a time period required for constructing a natural gas liquefaction plant can be shortened by achieving the above-described technical effects.

DESCRIPTION OF THE PREFERRED EMBODIMENT(S)

Embodiments of the present invention are described in the following with reference to the appended drawings.

Figure 1:
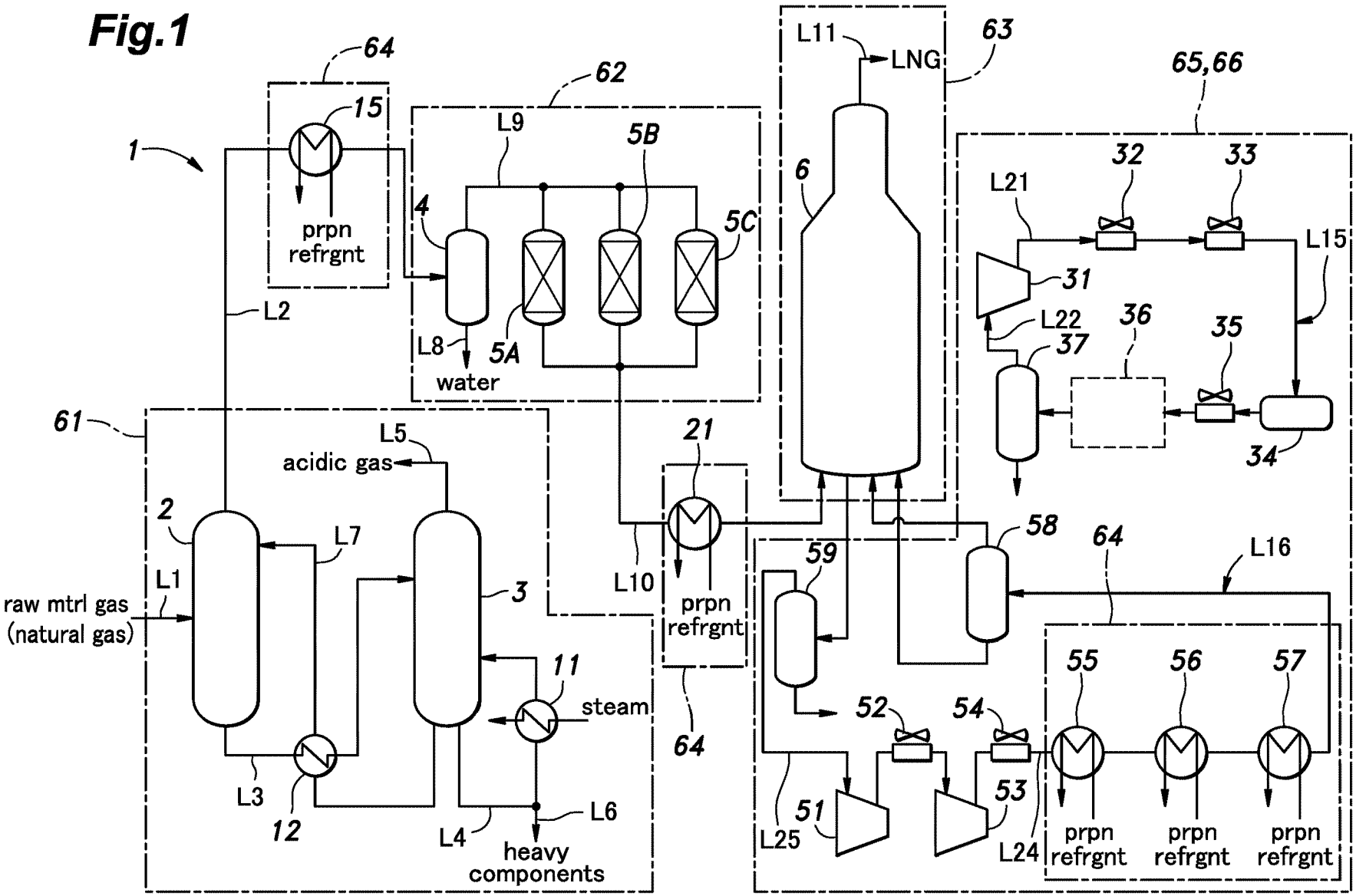
FIG. 1 is a schematic diagram showing a general configuration of a natural gas liquefaction plant in accordance with an embodiment of the present invention.

FIG. 1 is a schematic diagram showing a general configuration of a natural gas liquefaction plant (hereafter also referred to as "LNG plant") 1 in accordance with one embodiment of the present invention. In FIG. 1, each pipe for transporting a raw material gas or any other fluid is schematically shown by a line including an arrow.

The LNG plant 1 includes multiple facilities for producing a liquefied natural gas (LNG) by cooling a raw material gas. The LNG plant 1 includes an absorption tower 2 for removing acidic gas contained in the raw material gas, a regeneration tower 3 for regenerating an absorbent used in the absorption tower 2, a gas-liquid separator 4 for performing gas-liquid separation in order to separate moisture from the raw material gas, moisture removers 5A to 5C for removing moisture contained in the raw material gas, and a liquefier 6 for liquefying the raw material gas without unnecessary components (acidic gas, heavy components, moisture, mercury and other unnecessary components) which have been removed in the previous process.

The absorption tower 2 is composed primarily of a shelf plate tower including shelves provided at regular intervals therewithin, and causes components to be removed (acid gases and heavy components, in this case) to be absorbed into the absorbing liquid by bringing the absorbing liquid into countercurrent contact with the raw material gas supplied via a raw material gas transporting pipe L1. The raw material gas without the unnecessary components which have been removed in the absorption tower 2 is fed from a top of the tower to the gas-liquid separator 4 via a raw material gas transporting pipe L2. The absorbing liquid containing the absorbed components to be removed is fed to the regeneration tower 3.

The regeneration tower 3 is provided with shelves like the absorption tower 2, and treats the absorbing liquid at certain pressure and temperature to thereby separate the components to be removed from the absorbing liquid. In the regeneration tower 3, the absorbing liquid supplied from the absorption tower 2 drops within the tower from the upper part thereof via an absorbing liquid transporting pipe L3. Provided in a circulation pipe L4 connected to a bottom of the regeneration tower 3 is a reboiler 11, which serves as a heat source of the regeneration tower 3. The reboiler causes a part of the absorbing liquid discharged from the bottom of the regeneration tower 3 to be heated by heat exchange with a heat medium supplied from the outside of the reboiler 11, and then circulate in the regeneration tower 3. Acidic gas components such as carbon dioxide are recovered from a discharge pipe L5 connected to the top of the regeneration tower 3. Furthermore, heavy components (heavy hydrocarbons such as benzene) are recovered from a discharge pipe L6 branched from the circulation pipe L4 connected to the regeneration tower 3.

The absorbing liquid without the components to be removed, which have been separated in the regeneration tower 3, is supplied to an upper part of the absorption tower 2 again via an absorbing liquid transporting pipe L7. A heat exchanger 12 is provided between the absorbing liquid transporting pipe L3 and the absorbing liquid transporting pipe L7, and causes the absorbing liquid with a lower temperature flowing through the absorbing liquid transporting pipe L3 to be heated by heat exchange with the absorbing liquid having a higher temperature flowing through the absorbing liquid transporting pipe L7. After being cooled by the heat exchange, the absorbing liquid flowing through the absorbing liquid transporting pipe L7 is supplied to the absorption tower 2.

The absorbing liquid is a mixed absorbent containing a certain ratio of known chemical absorbent such as carbon dioxide, hydrogen sulfide, mercaptan, or carbonyl sulfide that absorbs acidic gas components through a chemical reaction, and a certain ratio of known physical absorbent that physically absorbs heavy hydrocarbons (heavy components) such as benzene, toluene and xylene contained in the raw material gas. The absorbing liquid also contains a certain ratio of water.

The absorption tower 2, the regeneration tower 3, and equipment and apparatuses included therein constitute an acidic gas removal facility 61, which removes the acidic gas contained in the raw material gas. The acidic gas removal facility 61 is not limited to one described above including the absorption tower 2 and the regeneration tower 3, and any other known equipment and apparatuses can be adopted as the facility as long as they are capable of removing acidic gases contained in the raw material gas.

The raw material gas from which the components to be removed have been removed in the absorption tower 2 to reach a prescribed concentration or less is cooled by a pre-cooling heat exchanger 15 provided on the raw material gas transporting pipe L2 and then fed to the gas-liquid separator 4. In the pre-cooling heat exchanger 15, propane refrigerant is used to cool the raw material gas whereby moisture in the raw material gas is condensed and discharged to the outside through a discharge pipe L8 as a liquid phase component in the gas-liquid separator 4. The raw material gas separated as a gas phase component in the gas-liquid separator 4 is supplied to the multiple moisture removers 5A to 5C via a raw material gas transporting pipe L9.

The moisture removers 5A to 5C are composed primarily of a dewatering tower filled with known moisture absorbent which physically adsorbs moisture. In the moisture removers 5A to 5C, in order to prevent troubles caused by freezing or the like in subsequent liquefaction processes, dehydration processing is performed until water content in the raw material gas is reduced to a prescribed ratio or less. The raw material gas without moisture which has been removed in the moisture removers 5A to 5C is cooled by propane refrigerant in a pre-cooling heat exchanger 21 provided on a raw material gas transporting pipe L10, and then supplied to the liquefier 6.

The moisture removers 5A to 5C and equipment and apparatuses included therein constitute a moisture removal facility 62, which removes moisture contained in the raw material gas. The moisture removal facility 62 is not limited to one described above which includes the moisture removers 5A to 5C, and other known equipment and apparatuses can be adopted as the facility as long as they are capable of removing moisture contained in the raw material gas.

The liquefier 6 is a main heat exchanger configured to liquefy, by heat exchange with a mixed refrigerant, the raw material gas without unnecessary components such as acid gases and heavy components which have been removed. The liquefier 6 include, but not limited to, a spool-wound type heat exchanger accommodated in a shell in which heat transfer tubing (tube bundle), through which the raw material gas and the mixed refrigerant flow, is wound like a coil. However, any other type of heat exchanger (e.g. a plate-fin type heat exchanger) may be used as the liquefier 6 as long as it can be used at least for liquefaction of the raw material gas. After the raw material gas is liquefied by cooling in the liquefier 6, the liquefied material exhibits a low temperature (approximately −162° C.) and is fed to an LNG tank (not shown) for storage via an LNG transporting pipe L11. In order to facilitate the liquefaction treatment in the liquefier 6, the raw material gas to be supplied to the liquefier 6 may be pressurized by a known compressor or any other compressing equipment.

The cooling/liquefying process of the raw material gas by the LNG plant 1 adopts what is called a Propane Pre-cooled Mixed Refrigerant Method, in which a raw material gas is cooled (pre-cooled) with propane refrigerant and then cooled (liquefied) with a mixed refrigerant as described above. Thus, the LNG plant 1 includes facilities for a propane pre-cooling system for cooling by propane refrigerant and those for a mixed-refrigerant system for cooling by a mixed refrigerant.

In the propane pre-cooling system, propane refrigerant which has been compressed in a refrigerant compressor 31 is supplied to a refrigerant transporting pipe L21 and cooled and condensed by a plurality of air-cooled heat exchangers 32, 33 which are provided on the refrigerant transporting pipe L21, and then introduced into a refrigerant tank 34. Thereafter, the propane refrigerant is introduced into an air-cooled heat exchanger 35 to be further cooled and then supplied to pre-cooling heat exchangers 15 and 21 for pre-cooling the raw material gas and refrigerant heat exchangers 55, 56 and 57 (as described later) for cooling the mixed refrigerant (collectively referred to as a propane-refrigerant-cooling section 36) where the propane refrigerant is used for cooling the raw material gas or cooling the mixed refrigerant. The propane refrigerant discharged from the cooling-by-propane-refrigerant site 36 is introduced into a gas-liquid separator (knockout drum in this case) 37 where a separated gas phase component is again discharged via a refrigerant transporting pipe L22 back to the refrigerant compressor 31. Such circulation of the propane refrigerant is implemented by a plurality of pipes including the above-described refrigerant transporting pipes L21 and L22 connecting the respective elements and equipment in the propane pre-cooling system (collectively referred to as a first refrigerant circulation pipe L15). FIG. 1 shows the facilities or equipment of the propane pre-cooling system independently of the other facilities or equipment for the purpose of illustration.

In the mixed refrigerant system, after the mixed refrigerant is pressurized by a first-stage refrigerant compressor 51, the mixed refrigerant is cooled by an air-cooled heat exchanger 52, pressurized by a second-stage refrigerant compressor 53, and then cooled by an air-cooled heat exchanger 54. Thereafter, the mixed refrigerant is supplied to via a refrigerant transporting pipe L24, and then introduced into a series of cooling elements, i.e. the refrigerant heat exchangers 55, 56, 57, where the mixed refrigerant is further cooled by high pressure propane refrigerant, intermediate pressure propane refrigerant, and low pressure propane refrigerant. Next, the mixed refrigerant is introduced into a refrigerant separator 58 in which the mixed refrigerant is separated into a gas phase component and a liquid phase component, and then the respective components are again introduced into the liquefier 6 where they are used for cooling the raw material gas. The mixed refrigerant discharged from the liquefier 6 is introduced into a gas-liquid separator (a knockout drum, in this case) 59, and a gas phase component separated in the gas-liquid separator is returned to the first-stage refrigerant compressor 51 via a refrigerant transporting pipe L25. As such, the circulation of the mixed refrigerant is implemented by using multiple pipes including the above-described refrigerant transporting pipes L24, L25 connecting each element and equipment (collectively referred to as a second refrigerant circulation pipe L16) in the mixed refrigerant system.

The pre-cooling heat exchangers 15, 21, the refrigerant heat exchangers 55, 56, 57 and equipment and apparatuses included therein constitute a mixed-refrigerant/raw-material cooling facility 64, which removes moisture contained in the raw material gas. The mixed-refrigerant/raw-material cooling facility 64 is not limited to one described above including the pre-cooling heat exchangers 15, 21 and the refrigerant heat exchangers 55, 56, 57, but other known equipment and apparatuses can be adopted as the mixed-refrigerant/raw-material cooling facility 64 as long as they are capable of cooling at least one of the mixed refrigerant the raw material gas.

The refrigerant compressor 31 in the propane pre-cooling system, the refrigerant compressors 51, 53 in the mixed refrigerant system, and equipment and apparatuses included therein constitute refrigerant compressing facilities, which compress the refrigerant (propane refrigerant or mixed refrigerant in this case) used to cool or liquefy the raw material gas. In the present embodiment, a first refrigerant compression facility 65 and a second refrigerant compression facility 66 are provided as the compressing facilities. The compressing facilities are not limited to those described above including the refrigerant compressors 31, 51, 53, and other known equipment and apparatuses can be adopted as the facilities as long as they are capable of compressing the refrigerant used to cool or liquefy the raw material gas.

For example, the configurations of the refrigerant compressor 31, the air-cooled heat exchangers 32, 33, 35 and the propane-refrigerant-cooling section 36 in the propane pre-cooling system (e.g. the type, number, arrangement of each piece of equipment or apparatus) may be changed as appropriate. Similarly, the configurations of the refrigerant compressors 51 and 53, the air-cooled heat exchangers (second air-cooled heat exchangers) 52 and 54, and the refrigerant heat exchangers 55, 56, 57 and other elements in the mixed refrigerant system may be changed as appropriated. FIG. 1 indicates the pre-cooling heat exchanger 21 and the air-cooled heat exchangers 32, 33, 35, 52, and 54 as single elements denoted by single reference numerals, respectively. However, each of the pre-cooling heat exchanger 21 and the air-cooled heat exchangers 32, 33, 35, 52, and 54 may be constituted by a plurality of heat exchangers. Similarly, each of the refrigerant compressors 31, 51, 53 can also be constituted by a plurality of compressors.

The mixed refrigerant includes, but not limited to, one obtained by adding nitrogen to a hydrocarbon mixture containing methane, ethane, and propane, but any other known components can be adopted as the mixed refrigerant as long as the desired cooling effect can be achieved. Furthermore, the cooling system for cooling the raw material gas is not limited to the one described herein, but any other known cooling systems for cooling the raw material gas may be used as the cooling system. Examples of such cooling systems include a cascade system in which individual refrigeration cycles are formed by multiple types of refrigerants (such as methane, ethane, and propane) having different boiling points, a DMR (Double Mixed Refrigerant) system in which a mixed refrigerant such as a mixture of ethane and propane is used for a pre-cooling process, and a Mixed Fluid Cascade (MFC) system in which heat exchange is performed step by step using different series of mixed refrigerants for pre-cooling, liquefaction, and supercooling cycles, respectively.

Examples of raw material gases to be treated in the LNG plant 1 include, but not limited to, natural gases obtained in a pressurized state from shale gas, tight sand gas, and coalbed methane. The raw material gas may be supplied to the LNG plant 1 not only from a gas field or other natural source via a pipe, but also from a gas storage tank or any other gas storage. The term "raw material gas" as used herein does not mean a gas in the strict sense of the word, but refers to any substance subject to liquefaction (including any substance to be treated during the process) in the LNG plant 1.

In the LNG plant 1, facilities for removing unnecessary components in the raw material gas prior to being supplied to the liquefier 6 are not limited to those described above, but may be other known facilities. Examples of such facilities to be provided between the moisture removers 5A to 5C and the liquefier 6 include a mercury removing facility (such as a fixed bed type adsorption tower filled with activated carbon) for removing mercury in the raw material gas, a heavy component removing facilities (such as expander, scrubbing tower, compressor, and rectifier) for removing heavy components (e.g. component with a high freezing point such as benzene or component with a high boiling point such as C5+ hydrocarbons). The LNG plant 1 may also include a nitrogen removing facility for removing nitrogen contained in the liquefied natural gas liquefied by the liquefier 6 to thereby adjust an amount of nitrogen contained in the liquefied natural gas, a heat source supplier for supplying heat medium liquid heated by heat exchange with the exhaust heat from the gas turbine to facilities in the LNG plant 1 so that the heat medium liquid is used to drive compressors, and a gas turbine facility including a fuel gas supplier configured to adjust the temperature and pressure of a fuel gas used to drive a gas turbine provided for driving compressors.

Figure 2:
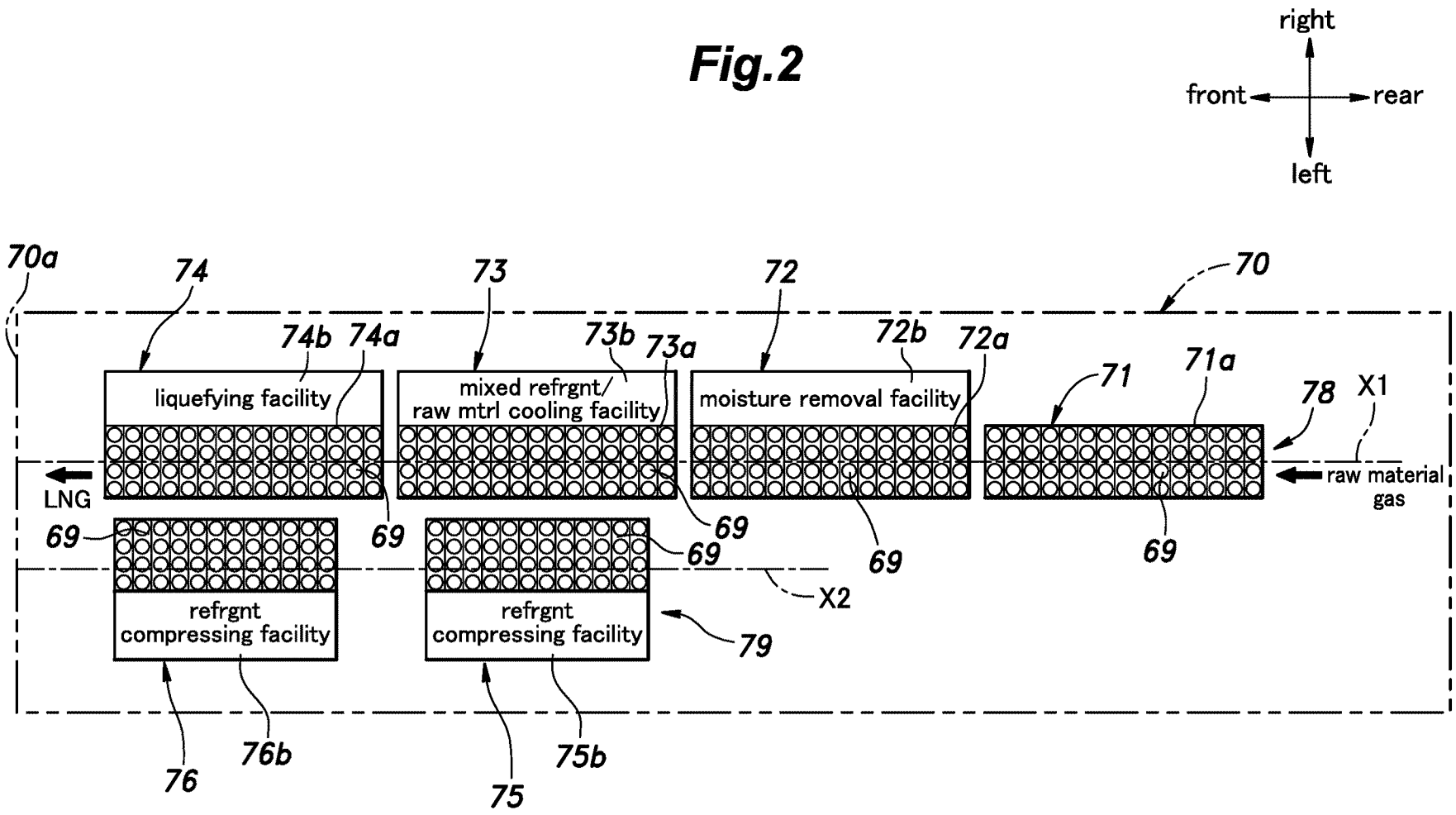
FIG. 2 is a top view of an example of arrangement of primary facilities in the natural gas liquefaction plant shown in FIG. 1.

FIG. 2 is a top view of an example of arrangement of main facilities in the LNG plant shown in FIG. 1. In this figure, the acidic gas removal facility 61 shown in FIG. 1 is omitted for the purpose of illustration. The configuration of the LNG plant 1 will be described with reference to FIG. 2, in which arrows indicate the front-rear direction and the right-left direction used in the description for explanatory convenience.

As shown in FIG. 2, first to sixth modules 71 to 76 including facilities and piping necessary for the LNG plant 1 are provided as the main part of the LNG plant 1 in a plant construction site 70.

Although the detailed configuration of each of the modules 71 to 76 is not shown, the first module 71 is comprised mainly of a piping section 71*a* including a piping rack provided with piping for transporting fluids such as the raw material gas, various components separated from the raw material gas, LNG, and refrigerant for cooling the raw material gas.

The second module 72 is comprised mainly of a piping section 72*a* on the left side and an equipment section 72*b* on the right side, where the piping section 72*a* includes a piping rack provided with piping connected mainly to the downstream side of the piping section 71*a* of the first module 71, and the equipment section 72*b* includes equipment and apparatuses related to the moisture removal facility 62 (see FIG. 1).

The third module 73 is comprised mainly of a piping section 73*a* on the left side an equipment section 73*b* on the right side, where the piping section 73*a* includes a piping rack provided with piping connected mainly to the downstream side of the piping section 72*a* of the second module 72, and the equipment section 73*b* includes equipment and apparatuses related to the mixed-refrigerant/raw-material cooling facility 64 (see FIG. 1).

The fourth module 74 is comprised mainly of a piping section 74*a* on the left side an equipment section 74*b* on the right side, where the piping section 74*a* includes a piping rack provided with piping connected mainly to the downstream side of the piping section 73*a* of the third module 73, and the equipment section 74*b* includes equipment and apparatuses related to a liquefying facility 63 (see FIG. 1).

The fifth and sixth modules 75 and 76 have substantially the same configuration. The fifth and sixth modules 75 and 76 are located on the left side of the third module 73 and the fourth module 74, respectively, and comprised mainly of equipment sections 75*b* and 76*b*, respectively, where the equipment section 75*b* and the equipment section 76*b* include the first refrigerant compression facility 65 and the second refrigerant compression facility 66, respectively, both configured to compress the refrigerant used for cooling and liquefying the raw material gas (FIG. 1). The refrigerant compressor 31 in the propane pre-cooling system, the refrigerant compressors 51, 53 in the mixed refrigerant system, and the air-cooled heat exchangers 52 for the mixed refrigerant and equipment and apparatuses included therein are disposed in or on the first refrigerant compression facility 65 and the second refrigerant compression facility 66 such that each of the elements may be disposed in or on either of the facilities 65, 63 regardless of which system the element belongs to.

The fifth module 75 is provided with an air-cooled heat exchanger group 69 disposed at the top of a frame 120 (FIGS. 4A to 4C) on the side of the third module 73 (first system 78 described later); that is, on the right side in FIG. 2. The fifth module 75 is provided with refrigerant piping 125 disposed therein (FIGS. 4A to 4C) to be connected to the piping of the piping section 73*a* of the third module 73.

Similarly, the sixth module 76 is provided with the air-cooled heat exchanger group 69 disposed at the top of the frame on the side of the fourth module 74; that is, on the right side in FIG. 2. Although not shown in the drawings, the sixth module 76 is provided with refrigerant piping disposed therein to be connected to the piping of the piping section 74*a* of the fourth module 74. The pieces of refrigerant piping of the fifth module 75 and the sixth module 76 are not connected directly to each other, but connected to each other via the pieces of piping located in the third module 73 and the fourth module 74.

The term "module" as used in the description of the present embodiment represents any modular configuration, which is not essentially required to include any specific functional facility such as the moisture removal facility 62, the liquefying facility 63, the mixed-refrigerant/raw-material cooling facility 64, the first refrigerant compression facility 65, or the second refrigerant compression facility 66, but is only required to include equipment or an apparatus forming a part of the LNG plant 1.

Each of the piping sections 71*a* to 74*a* includes main pipes having relatively large diameters such as raw material gas transport piping for transporting the raw material gas and LNG transport piping for transporting liquefied LNG. Each of the piping sections 71*a* to 74*a* is provided with an air-cooled heat exchanger group 69 for the refrigerant (propane refrigerant, mixed refrigerant in this case) at the top thereof. The air-cooled heat exchanger group 69 includes multiple air-cooled heat exchangers 32, 33, 54 arranged in series adjacent to one another in a front-rear direction.

In each of the equipment sections 72*b* to 74*b*, a frame for supporting equipment and apparatuses included therein is provided integrally with its piping rack.

The first to fourth modules 71 to 74 constitute a module group of the first system 78 and are arranged in a substantially straight row along the phantom axis line X1 extending in the front-rear direction. Although not shown, adjoining ones of the piping sections 71*a* to 74*a* of the modules are connected to each other. Each of the piping sections 71*a* to 74*a* includes an edge portion extending substantially linearly along the phantom axis line X1 on one side (the left side, in this case) of the first to fourth modules.

In the present embodiment, the first to fourth modules 71 to 74 have substantially the same width in the front-rear direction. The second and fourth modules 72 to 74 have substantially the same width in the left-right direction.

The fifth and sixth modules 75 and 76 constitute a module group of a second system 79 and are arranged in a substantially straight row along the phantom axis line X2 parallel to the phantom axis line X1. The fifth and sixth modules 75 and 76 are separated from each other, and the pieces of piping of the first refrigerant compression facility 65 and the second refrigerant compression facility 66 are connected to those of the third module 73 and the fourth module 74, respectively.

In the present embodiment, the fifth and sixth modules 75 and 76 have substantially the same widths in the front-rear direction and the left-right direction, respectively.

The first to sixth modules 71 to 76 are not necessarily limited to those including the above described equipment and apparatuses related to the facilities, and each module may include a part of equipment and apparatuses of an adjacent module having its specific functionality. The number and arrangement of modules in the LNG plant 1 may be changed as appropriate as long as the LNG plant 1 can be implemented.

Figure 3A:
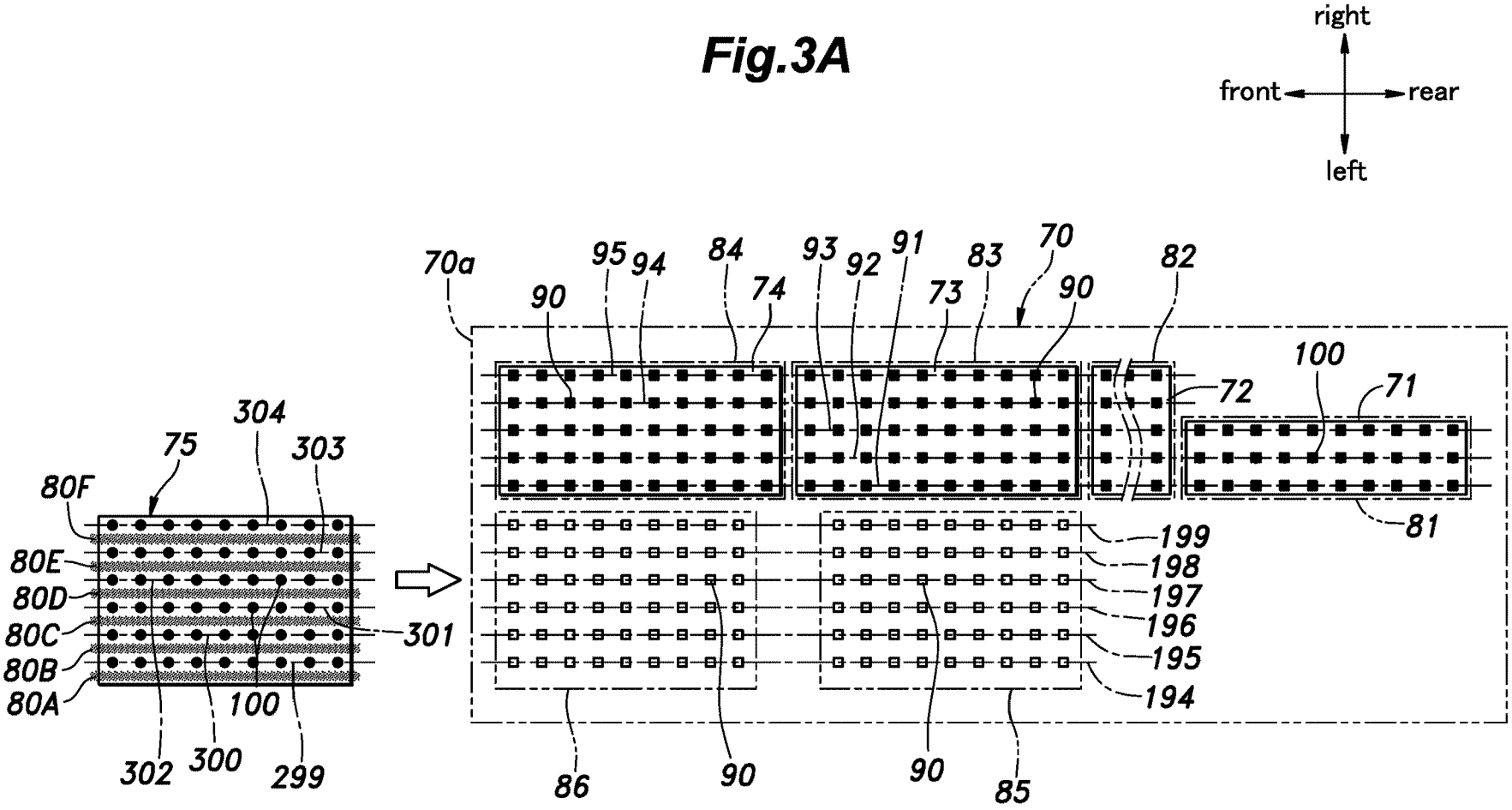
FIG. 3A is an explanatory view showing how a refrigerant compression module of a second system is transported and installed.
Figure 3B:
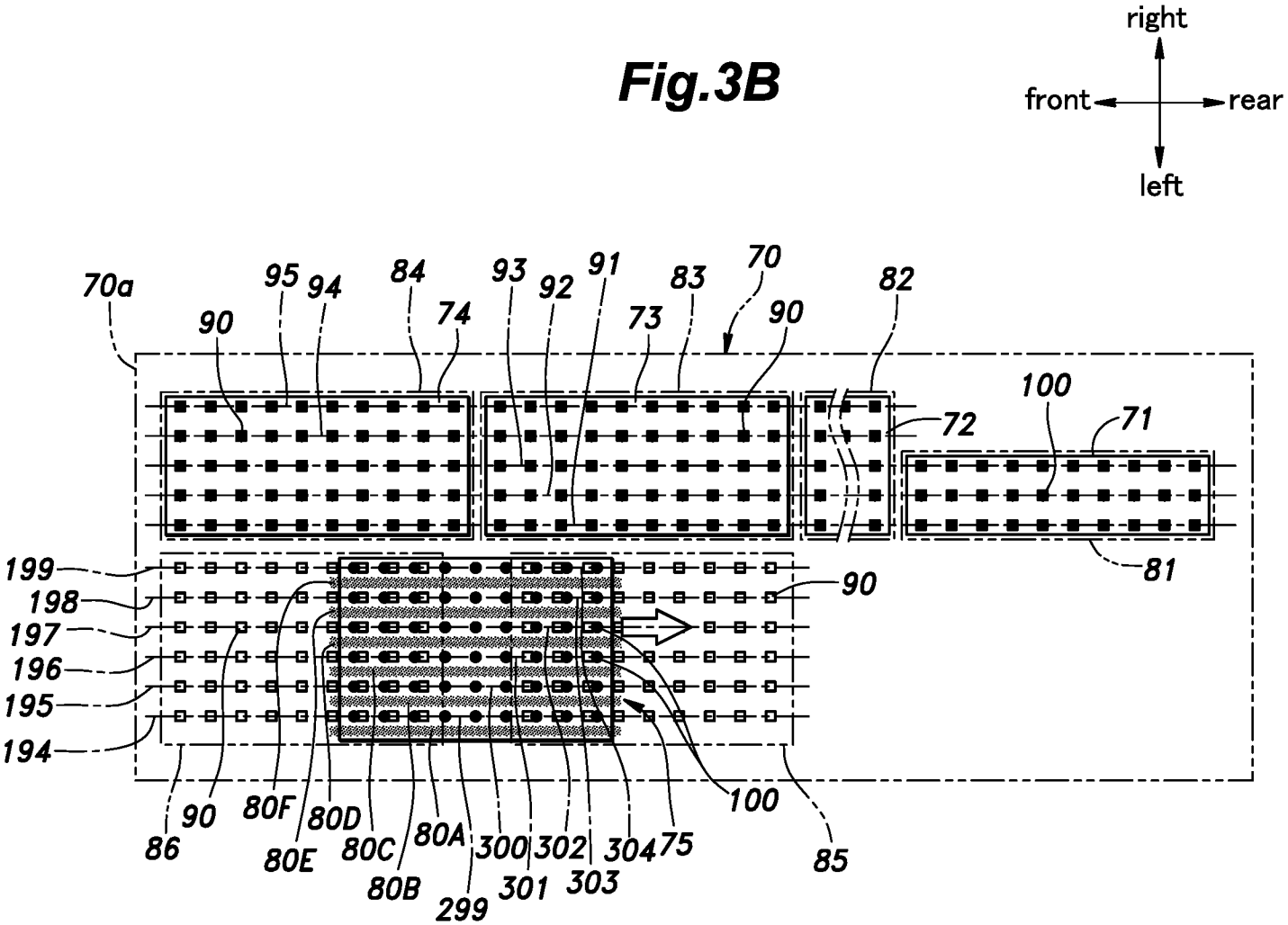
FIG. 3B is an explanatory view showing how the refrigerant compression module of the second system is transported and installed.
Figure 3C:
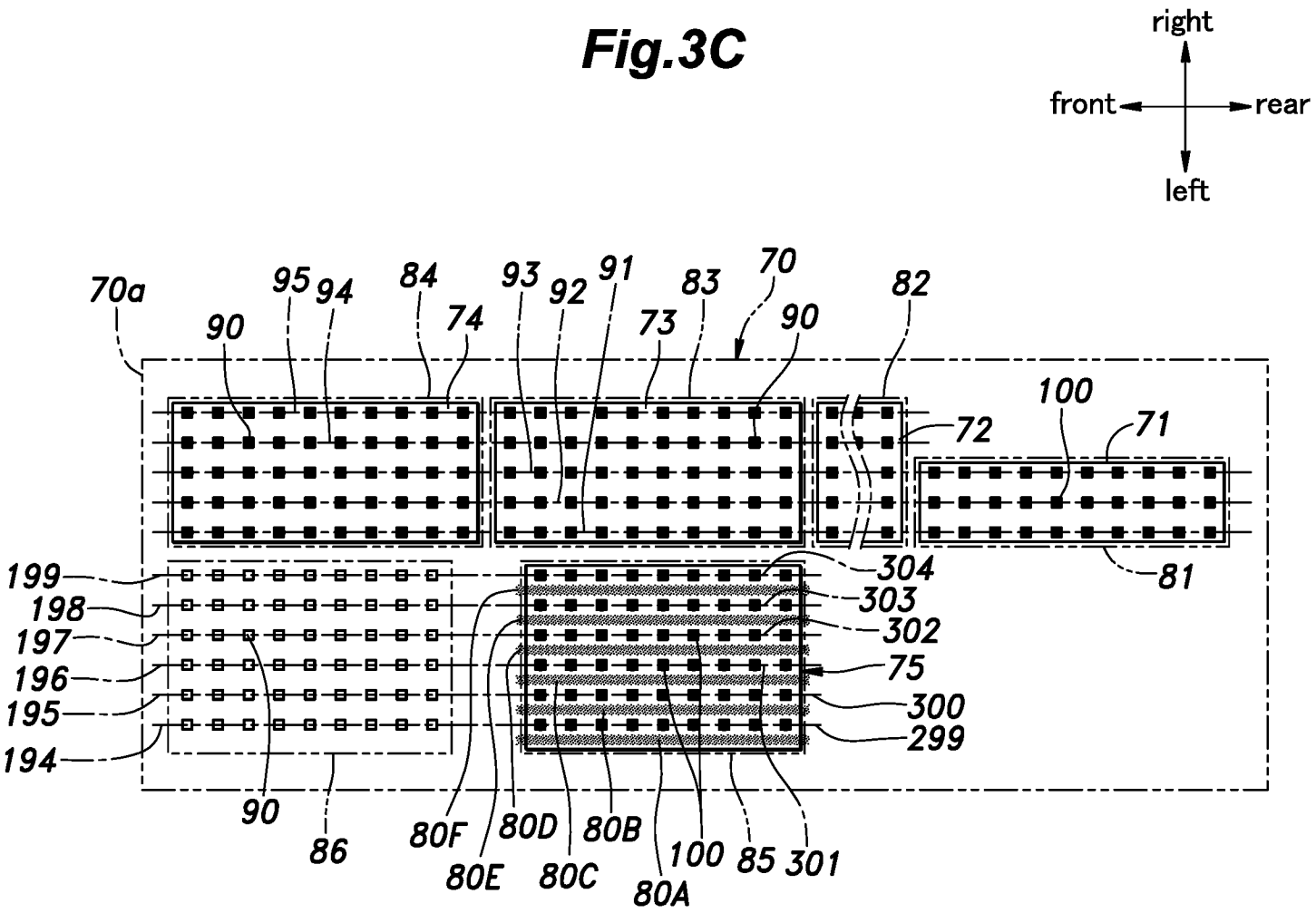
FIG. 3C is an explanatory view showing how the refrigerant compression module of the second system is transported and installed.

FIGS. 3A to 3C are explanatory views showing how a module in the second system 79 (hereafter, "refrigerant compression module") is transported.

The modules 71 to 74 of the first system 78 are transported from an entry site 70*a* for entering a plant construction site 70 to assigned installation areas 81 to 84, respectively, where the modules are to be installed. After the installation of the modules of the first system, the transporting step and the installing step are performed for the modules 75 and 76 of the second system 79, respectively, in the same manner.

In the transporting step performed for the refrigerant compression modules 75 and 76 of the second system 79, the refrigerant compression module 75 is transported by multiple transport vehicles 80A to 80F to an installation area 85 at first. The area 85 is assigned to the back side (downstream side) in the transport direction as shown in FIG. 3A, for example. The transporting step and the installing step are performed for the refrigerant compression module 76 to be installed in an installation area 86 assigned thereto as well as the refrigerant compression module 75.

The transport vehicles 80A to 80F start transporting the refrigerant compression module 75 from the entry site 70*a* of the plant construction site 70 in the travel direction (rearward) indicated by the arrow, while supporting the bottom of the refrigerant compression module 75. Then, as shown in FIG. 3B, the transport vehicles 80A to 80F move along their travel paths between multiple supports 90 (that is, supports for each module 75 to 76) in the installation area 86 (on the upstream side in the transport direction) and the multiple supports 90 in the installation area 85, thereby transporting the refrigerant compression module 75 from the entry site 70*a* to the installation area 85.

The transport vehicles 80A to 80F may be self-propelled module transporters (SPMTs) having multiple wheels for traveling on the ground. In the present embodiment, six transport vehicles 80A to 80F on six tracks are used to transport one refrigerant compression module 75 in a row, but the number of transport vehicles to be used may be changed as appropriate.

In this configuration, multiple leg portions 100 are provided at the bottom of the module 75 so as to extend downward from a main body of the module at positions corresponding to the respective supports 90 in the installation area 85. The multiple leg portions 100 constitute multiple leg portion rows 299 to 304 extending in the front-rear direction (the traveling direction of the transport vehicles 80A to 80F) in rows.

In this embodiment, travel paths of the transport vehicles 80A to 80F are defined by the multiple supports 90 which form support rows 194 to 199. For example, the travel path for the transport vehicle 80A is defined as the left side region (ground) of the support row 194, the travel path for the transport vehicle 80B is defined as a region between the support rows 194 and 195; the travel path for the transport vehicle 8C is defined as a region between the support rows 195 and 196; the travel path for the transport vehicle 8D is defined as a region between the support rows 196 and 197; the travel path for the transport vehicle 8E is defined as a region between the support rows 197 and 198; and the travel path for the transport vehicle 8E is defined as a region between the support rows 198 and 199.

In this case, the multiple supports 90 forming the support rows 194 to 199 are arranged such that the supports 90 are positioned at intervals in a direction (left-right direction) orthogonal to the travel direction of the transport vehicles 80A to 80F and in alignment with the corresponding supports of the second group of modules, respectively.

Then, when the transport vehicles 80A to 80F reach the installation area 85 of the refrigerant compression module 75, an installation step is performed in which the refrigerant compression module 75 is secured to the supports 90 in the installation area 85 as shown in FIG. 3C. In the installation step, the lower portions of the multiple leg portions 100 of the module 75 are connected to the upper portions of the corresponding supports 90.

Figure 4A:
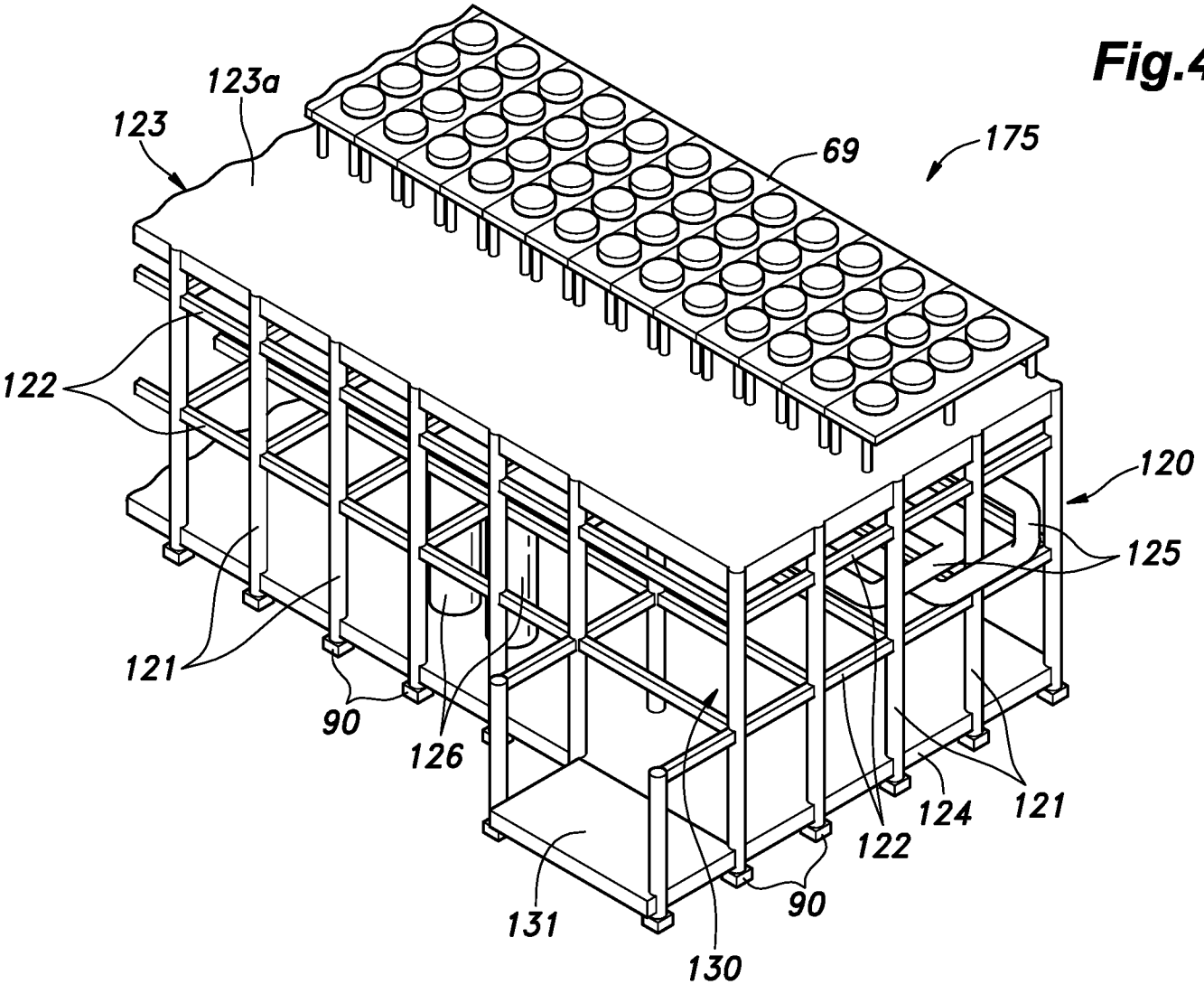
FIG. 4A is an explanatory view showing how a refrigerant compressor is mounted in a refrigerant compression module body.
Figure 4B:
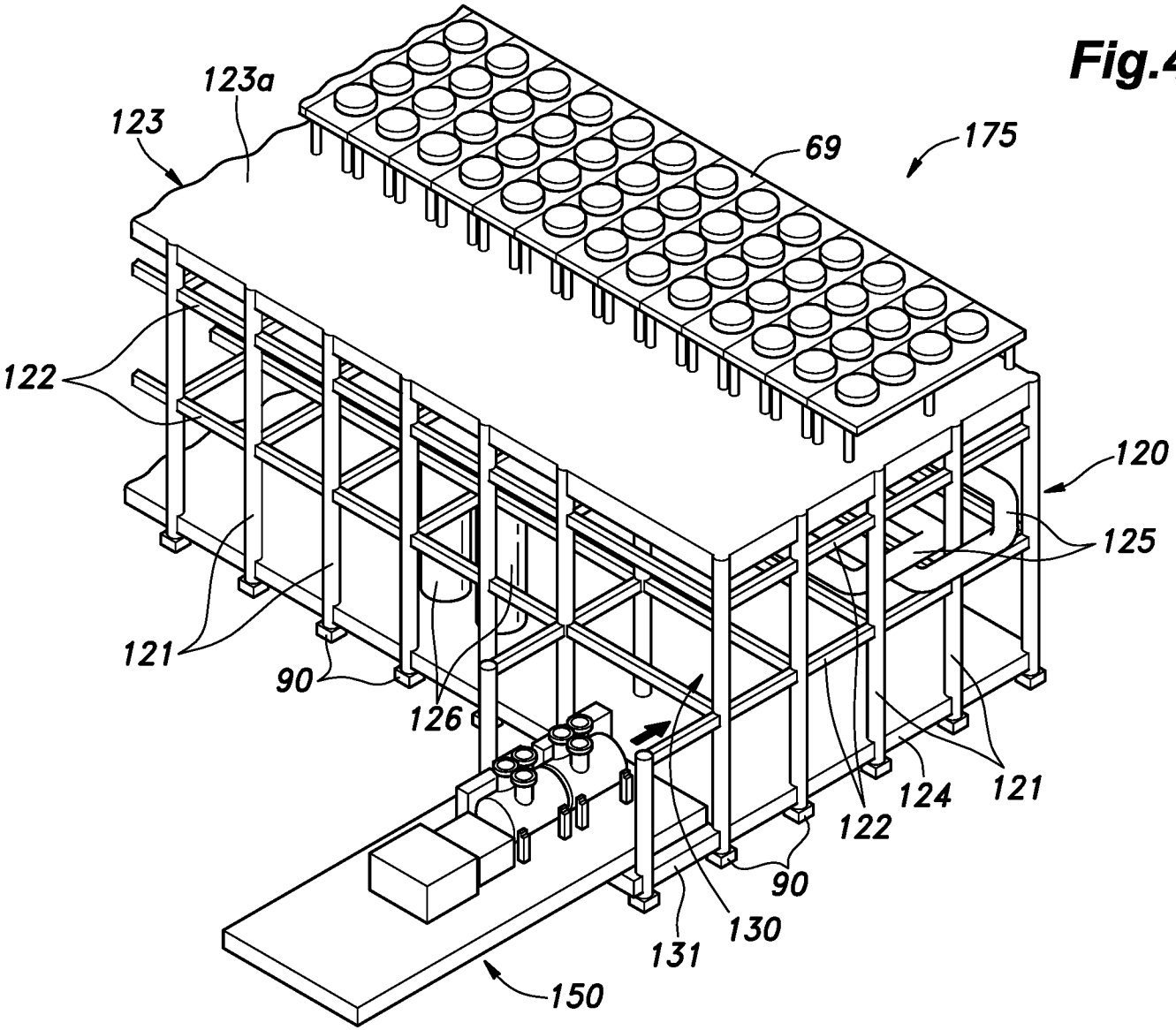
FIG. 4B is an explanatory view showing how the refrigerant compressor is mounted in the refrigerant compression module body.
Figure 4C:
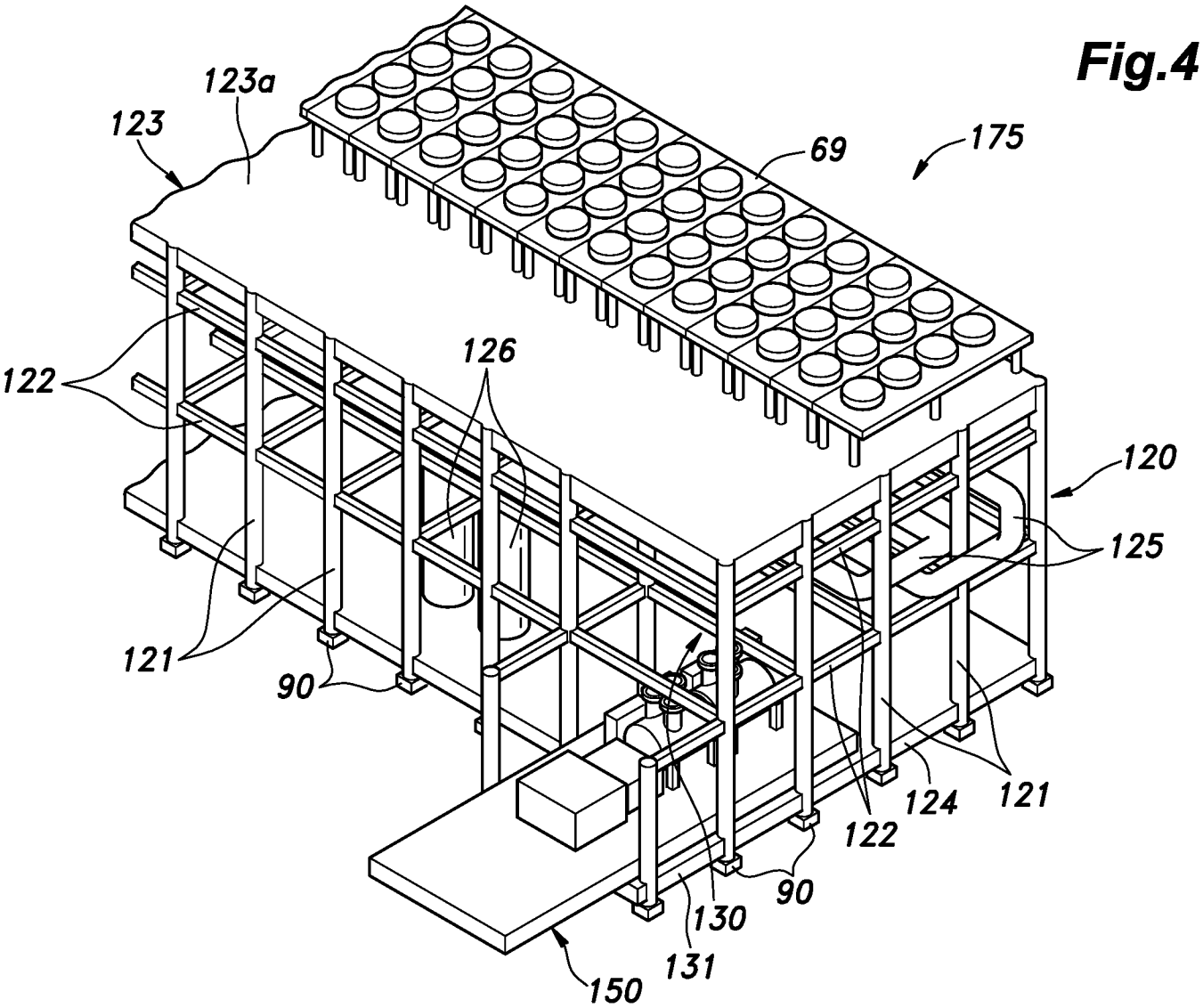
FIG. 4C is an explanatory view showing how the refrigerant compressor is mounted in the refrigerant compression module body.

It should be noted that the above-described transportation step and the installation step can also be performed for the refrigerant compression module 75, which is, more strictly, a refrigerant compression module body 175, in which equipment and apparatuses to be mounted in the refrigerant compression module 75 (a refrigerant compressor 150, in this case) have not been completely mounted (FIGS. 4A to 4C). Details of a refrigerant compressor mounting step, in which the refrigerant compressor 150 is mounted in the refrigerant compression module body 175 which has been installed in the installation step, will be described.

Figure 5:
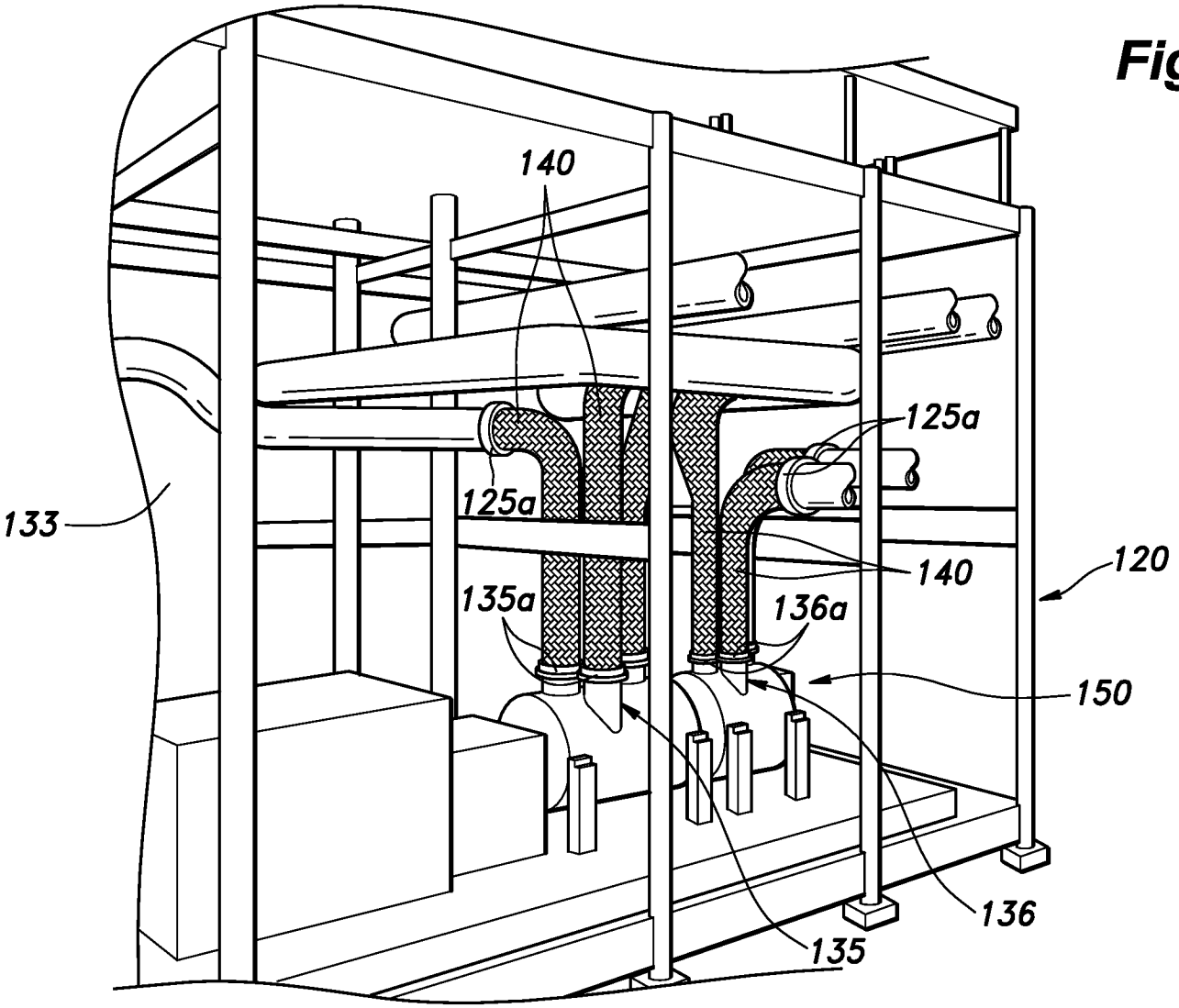
FIG. 5 is a perspective view showing how pipes are connected each other in the refrigerant compressor mounted in the refrigerant compression module body.
Figure 6:
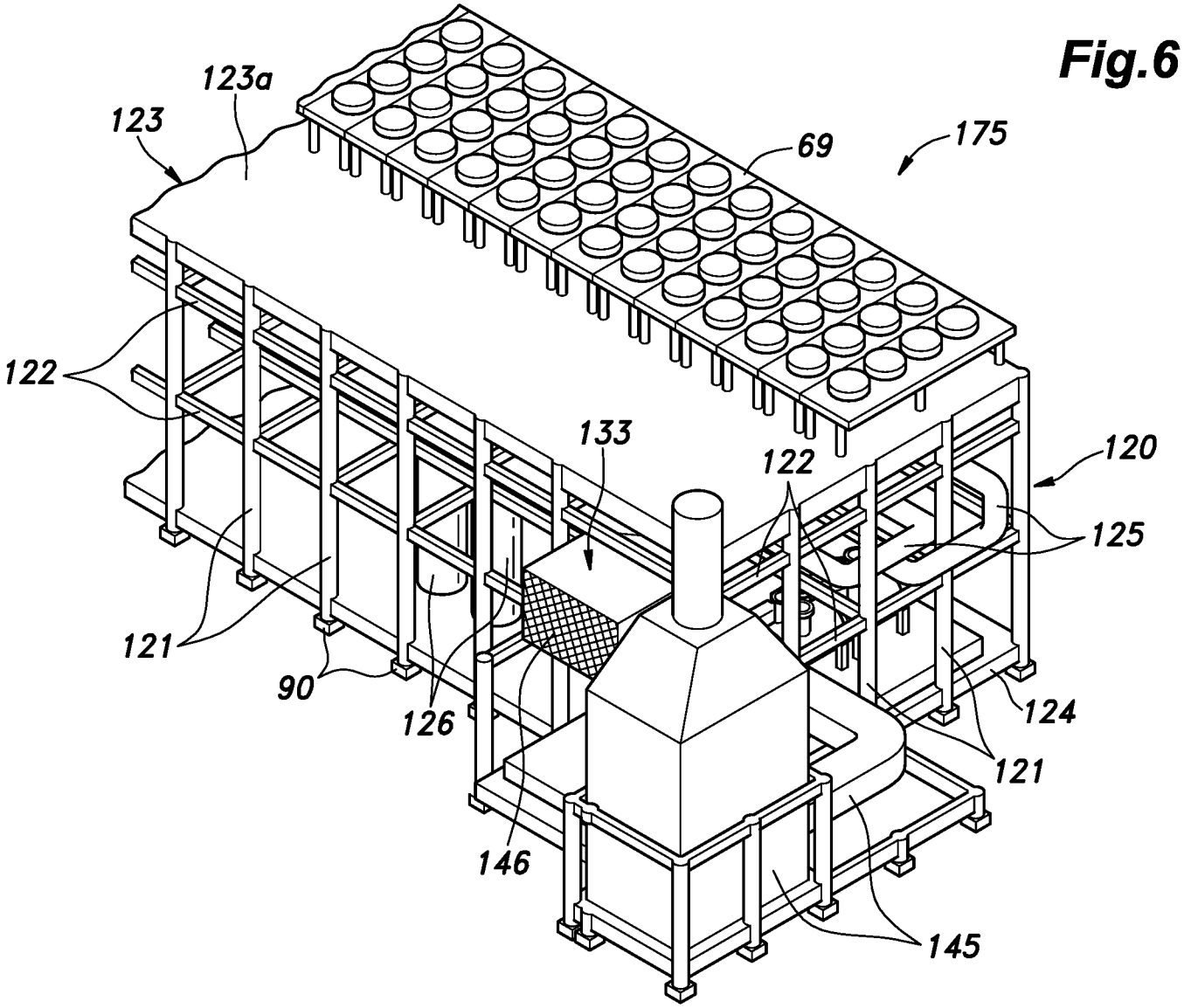
FIG. 6 is a perspective view showing the refrigerant compression module after the refrigerant compressor is mounted therein.

FIGS. 4A to 4C are explanatory views showing how the refrigerant compressor 150 is mounted in the refrigerant compression module body 175. FIG. 5 is a perspective view showing how pipes are connected each other in the refrigerant compressor 150 mounted in the refrigerant compression module body 175. FIG. 6 is a perspective view showing the refrigerant compression module 75 after the refrigerant compressor 150 is mounted therein.

As shown in FIG. 4A, the refrigerant compression module body 175 includes a frame 120. In the frame 120, the first refrigerant compression facility 65 or the second refrigerant compression facility 66 is mounted. However, the figure shows only part of the equipment and apparatuses (including piping) included in the first refrigerant compression facility 65 for the purpose of illustration.

The frame 120 includes multiple pillars 121 arranged at predetermined intervals and extending in the vertical direction; multiple of beams 122 arranged at predetermined intervals and extending in a horizontal direction; and a roof 123 and a floor 124 which are substantially flat. Moreover, the bottom of the frame 120 (including the lower ends of the pillars 121) is installed on the supports 90 in the installation step. Although not shown in the drawings, the frame 120 may have braces.

The roof 123 and the floor 124 define the uppermost part and the lowermost part, respectively, of a space for accommodating equipment and apparatuses included therein in the refrigerant compression module body 175. Provided in the space are refrigerant pipes 125 (refrigerant circulation pipes L15, L16 and refrigerant transport pipes L21, L22, L24, L25 as shown in FIG. 1 and other pipes) and a gas-liquid separator 126 (such as the gas-liquid separators 37 and 59 shown in FIG. 1). On an upper surface 123*a* of the roof 123, heat exchangers of the air-cooled heat exchanger group 69 (such as the air-cooled heat exchanger 52 in FIG. 1) are arranged on the side of the first system 78.

In addition, the frame 120 includes a mounting space 130 which can accommodate the refrigerant compressor 150 therein. The mounting space 130 is a substantially cubic space located on and above the floor 124 and defined by the pillars 121, the beams 122 or other elements.

Next, as shown in FIG. 4B, a refrigerant compressor mounting step, in which the refrigerant compressor 150 is mounted in the refrigerant compression module body 175, is started. Then, as shown in FIG. 4C, the refrigerant compressor 150 is moved on the floor 124 and the refrigerant compressor 150 is inserted into the frame 120. Finally, as shown in FIG. 5, the refrigerant compressor 150 is secured on the floor 124.

At this stage, the frame 120 (the refrigerant compression module body 175) has a rectangular outer peripheral edge in plan view, as shown in FIG. 2 (see the fifth module 75). As shown in the example of FIGS. 4 and 5, an insertion part 131 (i.e. a place where an entrance to the frame 120 is formed) is formed so as to extend out from a side of the rectangular outer peripheral edge, through which the refrigerant compressor 150 can be inserted into the mounting space 130 of the frame 120 on the insertion part 131.

Accordingly, the refrigerant compression module body 175 is installed before the refrigerant compressor 150 is mounted into the refrigerant compression module body 175, which can shorten a construction time period by minimizing effect of a lead time for the refrigerant compressor thereon.

Another frame may be provided so as to blockade the entrance of the insertion part 131 after the refrigerant compressor 150 is mounted in the mounting space 130. In the present embodiment, the refrigerant compressor 150 is driven by a gas turbine 133 which uses LNG as a fuel.

Referring to FIG. 5, the refrigerant compressor 150 is provided with multiple refrigerant inlet pipes 135 for supplying the compressed refrigerant thereto, and multiple refrigerant outlet pipes 136 for discharging the compressed refrigerant therefrom. The refrigerant inlet pipes 135 and the refrigerant outlet pipes 136 have their connection ends 135*a*, 136*a*, respectively, which are located near connection ends 125*a* of the refrigerant piping 125 arranged in the frame 120.

As described above, after the refrigerant compressor 150 is disposed, a connecting step is performed to connect the connection ends 135*a* of the refrigerant inlet pipes 135 and the connection ends 136*a* of the refrigerant outlet pipes 136 with their corresponding refrigerant pipes 125 via joint pipes 140. In this way, by using the joint pipes 140, the stable connection of the refrigerant inlet and outlet pipes 135, 136 of the refrigerant compressor 150 to their corresponding refrigerant pipes 125 provided in the refrigerant compression module body can be achieved regardless of how accurately the refrigerant compressor 150 is mounted.

In addition, as shown in FIG. 5, the refrigerant inlet and outlet pipes 135, 136 are preferably provided so as to protrude upward from a body of the refrigerant compressor 150. This configuration advantageously enables easy connections between the refrigerant inlet and outlet pipes 135, 136 and their corresponding refrigerant pipes 125 provided in the frame 120.

After (or concurrently with) connecting the refrigerant inlet pipes 135 and the refrigerant outlet pipes 136 to their corresponding refrigerant pipes 125 provided in the frame 120, as shown in FIG. 6, a pipe providing step is performed to provide an exhaust gas pipe 145 (including a chimney outlet) outside the frame, the exhaust gas pipe allowing exhaust gas to be discharged outside from a gas turbine 133. In this way, after connecting the refrigerant inlet pipes 135 and the refrigerant outlet pipes 136 to their corresponding refrigerant pipes 125 in the frame 120, the exhaust gas pipe 145 for discharging exhaust gas from a gas turbine 133 is provided outside the frame 120. This configuration allows the mounting space 130 for the refrigerant compressor 150 in the frame of the refrigerant compression module body 175 and thus the size of the refrigerant compression module body to be compact, while minimizing time period for the refrigerant compressor mounting step.

Moreover, as shown in FIG. 6, an intake port 146 of the gas turbine 133 is preferably provided such that, after completing connections of the pipes, the intake port extends out of the frame 120 in the same manner as the exhaust gas pipe 145. This configuration enables a stable air intake of the gas turbine 133 for driving the refrigerant compressor 150 with the simple structural feature.

Although the present invention has been described based on specific embodiments, these embodiments are merely exemplary and are not intended to limit the scope of the present invention. All the elements of the method for constructing a natural gas liquefaction plant according to the present invention shown in the above embodiments are not necessarily essential and can be appropriately selected as long as they do not deviate from at least the scope of the present invention.

Glossary

1 LNG plant
2 absorption tower
3 regeneration tower
4 gas-liquid separator
5A to 5C moisture remover
6 liquefier
15, 21 pre-cooling heat exchanger
31 refrigerant compressor
32, 33, 35 air-cooled heat exchanger
51, 53 refrigerant compressor
52, 54 air-cooled heat exchanger
55, 56, 57 refrigerant heat exchanger
58 refrigerant separator
61 acidic gas removal facility
62 moisture removal facility
63 liquefying facility
64 mixed-refrigerant/raw-material cooling facility
65 first refrigerant compression facility
66 second refrigerant compression facility
69 air-cooled heat exchanger group
70 plant construction site
70*a* entry site
71 to 76 module
71*a* to 74*a* piping section
72*b* to 76*b* equipment section
78 first system
79 second system
80A to 80F transport vehicle
81 to 86 installation area
90 support
100 leg portion
120 frame
125 refrigerant pipe
130 mounting space
131 insertion part
133 gas turbine
135 refrigerant inlet pipe
136 refrigerant outlet pipe
140 joint pipe
145 exhaust gas pipe
146 intake port
150 refrigerant compressor
175 refrigerant compression module body
194 to 199 support row
299 to 304 leg portion row

The invention claimed is:

1. A method for constructing a natural gas liquefaction plant including a modularized facility, the method comprising:

transporting a refrigerant compression module body to an installation area, wherein the refrigerant compression module body is provided with a frame configured to allow a refrigerant compressor to be mounted therein, the refrigerant compressor compressing a refrigerant used to cool natural gas;

installing the refrigerant compression module body in the installation area; and mounting the refrigerant compressor into a mounting space predefined in the frame of the installed refrigerant compression module body, wherein the installing of the refrigerant compression module body in the installation area is performed before the refrigerant compressor to be mounted in the refrigerant compression module body has been mounted in the refrigerant compression module body.

2. The method according to claim 1, wherein one or more air-cooled heat exchangers are disposed at a top of the frame, and wherein at least a part of the mounting space is located below the one or more air-cooled heat exchangers.

3. The method according to claim 1, wherein the refrigerant compressor is secured on a floor at a lowest part of the frame.

4. The method according to claim 1, wherein the refrigerant compressor comprises a refrigerant inlet pipe and a refrigerant outlet pipe, wherein the refrigerant compression module body comprises two refrigerant pipes which correspond to the refrigerant inlet pipe and the refrigerant outlet pipe, respectively, and wherein, in the step of mounting the refrigerant compressor, the refrigerant inlet pipe and the refrigerant outlet pipe are connected to their corresponding refrigerant pipes via joint pipes.

5. The method according to claim 4, wherein both the refrigerant inlet pipe and the refrigerant outlet pipe are provided so as to protrude upward from a body of the refrigerant compressor.

6. The method according to claim 1, wherein the refrigerant compressor is driven by a gas turbine, and wherein the method further comprises arranging an exhaust gas pipe outside the frame, the exhaust gas pipe allowing exhaust gas to be discharged outside from the gas turbine.

7. The method according to claim 6, wherein an intake port of the gas turbine is provided such that, when the refrigerant compressor is mounted in the mounting space, the intake port extends out of the frame.

* * * * *